US005343643A

United States Patent [19]

Cochrane

[11] Patent Number: 5,343,643

[45] Date of Patent: Sep. 6, 1994

[54] COLLAPSIBLE BORDER ASSEMBLY

[76] Inventor: Ian R. Cochrane, 5 Lees Heights, Charlbury, Oxon, OX7 3EZ, England

[21] Appl. No.: 867,215

[22] PCT Filed: Dec. 4, 1990

[86] PCT No.: PCT/GB90/01881

§ 371 Date: Jun. 4, 1992

§ 102(e) Date: Jun. 4, 1992

[87] PCT Pub. No.: WO91/07986

PCT Pub. Date: Jun. 13, 1991

[30] Foreign Application Priority Data

Dec. 4, 1989 [GB] United Kingdom ..... 8927376.7
Jun. 5, 1990 [GB] United Kingdom ..... 9012549.3

[51] Int. Cl.[5] ..... A47G 1/10; A47G 1/06
[52] U.S. Cl. ..... 40/155; 40/156
[58] Field of Search ..... 40/156, 155, 153, 159.1, 40/152, 152.1

[56] References Cited

U.S. PATENT DOCUMENTS 373,384 11/1887 Works .
2,442,967 6/1948 Barasch et al. ..... 40/155

FOREIGN PATENT DOCUMENTS 1013325 7/1952 France ..... 40/155
585887 11/1958 Italy ..... 40/155
23571 of 1896 United Kingdom ..... 40/153

*Primary Examiner*—Kenneth J. Dorner
*Assistant Examiner*—C. Davis
*Attorney, Agent, or Firm*—Chilton, Alix & Van Kirk

[57] ABSTRACT

A collapsible border assembly (1) for a picture, clip-frame, mirror, glass pane or other object (2), comprises a plurality of corner pieces (3), adapted for detachable engagement with corners of the object (2), and a number of elastic elements (4,5) interconnecting adjacent ones of the corner pieces (3). In use, the elastic elements (4,5) extend under tension between the corner pieces (3), around the periphery of the object (2), to thereby provide a border for the object (2) of frame-like appearance. Such border assemblies (1) may be stacked one above the other to provide a stepped frame appearance.

13 Claims, 6 Drawing Sheets

COLLAPSIBLE BORDER ASSEMBLY

The present invention relates to a collapsible border assembly for providing a frame-like border around a picture, mirror, glass pane or the like.

A well-known and popular way of mounting pictures, prints, photographs etc is to use a so-called "frameless frame" or "clip-frame" assembly. Such an assembly consists of a supporting back panel and a glass front plate. The picture or other item to be displayed is sandwiched between the back panel and the front plate, and the whole assembly is held together by a number of small metal clips. These assemblies are considerably less expensive than traditional bespoke picture frames, but are usually sold without a surrounding frame or border.

A known method of forming a surrounding frame for a picture so mounted is to use prefabricated channel-shaped plastic elements, which clip around the edges of the glass. Whilst these prefabricated frames are again less expensive than traditional ones, they do not always fit very well, with unsightly gaps sometimes appearing between the glass plate and the plastic frame. Also, an inherent disadvantage with frames of this type is that any single frame may only be used to fit one particular size of picture.

Thus, from one aspect, the invention provides a collapsible border assembly for a picture, clip-frame, mirror, glass pane or other like object, comprising a plurality of corner pieces adapted for detachable engagement with respective corners of the object, adjacent ones of the corner pieces being interconnected by elastic elements arranged, in use, to extend under tension between the corner pieces and along the peripheral edges of the object, the elastic elements and corner pieces together providing a border for the object of frame-like appearance.

The invention in a second aspect extends to a method of providing a border around a picture, mirror, glass pane or other like object comprising engaging thereon an assembly as described above.

In this way, a clip-frame assembly may be provided with an aesthetically pleasing border which resembles a traditional picture frame but is much less expensive, with the elastic elements under tension bearing a surprising resemblance to a rigid frame.

Further, there is no need to manufacture a number of differently sized frames since the elastic elements may accommodate, within limits, a range of different sizes of clip-frame assembly. Therefore, should the owner of a picture replace it by another of differing size, the surrounding border assembly may simply be removed from the old one and fitted to the new one, doing away with the need to buy a second frame.

Moreover, the invention is not, of course, limited to use with clip-frame assemblies or pictures, but may be used in place of a standard frame on a wide variety of objects, such as, for example, mirrors and advertising displays.

Because the elastic elements are held in tension between the corner pieces, they are positively urged to run in a straight line and to lie flat against the edges of the object. Therefore, when they are positioned on, for example, a clip-frame assembly, the elastic elements may lie flat against the front plate and side edges of the assembly without leaving any unsightly gaps.

The present invention provides a border assembly which is quick and easy to fit or remove, is inexpensive to produce, is well-fitting, is versatile and may be used on a variety of differently sized and shaped objects. Further, the invention has the advantage that it may be packed into a small space for ease of storage and may be packaged into a small gift box for presentation and marketing purposes.

Preferably, the elastic elements are arranged so that when under tension in use, they provide a pair of front and side surfaces substantially at right-angles to one another between each pair of adjacent corner pieces. Such an arrangement allows for the front surface to lie flat against the periphery of, for example, the glass plate of a clip-frame assembly whilst the side surface engages a side edge of the assembly. A conventional rectangular frame-like appearance can thus be provided.

The orientation of the surfaces of the tensioned elements may be defined by engaging the elastic elements with the corner pieces in substantially right angular configurations, so that when the elements are stretched between adjacent corner pieces they automatically conform to a right angle cross-section along their lengths.

The front and side surfaces can be provided by individual elastic elements so that two elastic elements extend between each pair of adjacent corner pieces, or they may, be provided by a single elastic element. In the first case, the elastic elements may be connected together or separate, whilst in the latter case, the elastic element may be folded along its length down a line of weakness or fold line.

There are many possible ways of connecting the elastic elements to the corner pieces, i.e. by adhesive, tacks or the like, and they may be connected to the corner pieces by connecting means such as hook means or plug means. Alternatively, the elastic elements may be defined by one or more continuous elastic loops, which can be, for example, slidably engaged with the corner pieces at any desired point along its/their length. This embodiment lends itself to automated assembly, and has the advantage of being more readily able to adjust to a variety of different picture shapes, the tension in the loop remaining equal throughout its length.

The corner pieces may take any desired form, provided, of course that they are engageable with the corners of the object. Preferably, the corner pieces comprise guide channels defining a right angular cross section.

Where the elastic elements are in the form of a loop or loops, ramps may be provided in the guide channels to help guide the elastic loop(s) through the change in direction which occurs at the corners. The ramps minimise the amount by which the elastic loops become tucked up at the point where they change direction and also stop the side surfaces of the elements from riding up into the front channel portions. Guide ribs may also be provided in the guide channels to co-operate with ribs formed on the surfaces of the elastic elements. These ribs, and the ramps, prevent the loop(s) from splaying out and trying to straighten up.

To allow the continuous loops to be inserted into the guide channels, slots may be provided in the corner pieces, which extend along the lengths of the channels.

Where the elastic elements are not formed from continuous loops, hook means or other suitable connection means may be housed in the guide channels to engage the elastic elements.

In one preferred embodiment, the corner pieces are adapted so that they can stack one on top of the other. This then allows a number of collapsible border assemblies to be fitted on top of one another, so that the borders give the appearance of a stepped frame. Thus, with this "frame-on-frame" arrangement, the variability of the invention and the varieties of border appearances which can be produced are increased enormously.

Preferably, therefore, each corner piece comprises interlocking formations on its inner and/or outer sides, such as a mating projection or recess, arranged such that one corner piece may optionally be interengaged above or below a further corner piece having a cooperating such formation, e.g. by push or snap-fitting. Where slots are provided in the corner pieces to allow for the insertion of the elastic elements into the guide channels, these slots may comprise one element of the interlocking formations.

Whilst the tension in the elastic elements acts to hold the corner pieces on the object, in order to ensure that the assembly remains firmly engaged with the object, the corner pieces may be provided with seating channels which engage the edges of the object to hold the corner pieces thereon. These channels may take any suitable form and in a preferred embodiment a side wall of the seating channel has an arcuate shaped surface which in use curves away from the surface of the object with which it contacts, so that, when a corner piece is engaged with a corner of the object, the arcuate side wall is pushed outwardly and exerts a reactive force on the surface of the object to hold the corner piece in clamping engagement with the object, the corner piece squeezing the edge of the object between the arcuate side wall and the opposite side wall of the seating channel.

Such channels cannot generally be used when the corner pieces are adapted to stack upon one another to give a "stepped frame" appearance, and so they may be removable, thus allowing a border assembly to be used by itself or with others. Instead of the seating channel, the corner piece could be provided with a tab positioned opposite the front guide channel portion of the corner piece. The corner piece would then grip the object between the front channel portion and the tab. As with the side wall above, the tab may be arcuate in shape.

The number of corner pieces used will depend on the shape of the object. The elastic elements and corner pieces may be made of any suitable material and may be of any colour, texture or pattern, thus providing a number of different varieties of frame-like borders. Also, many variations on the "frame-on-frame" feature may be envisaged. For example, the first border could have the appearance of a normal rectangular border, whilst the second could merely be an elastic loop which extends around the sides but not the front of the object. This loop could be spaced from the first border by decorative corner pieces, and tubular bars or other objects could be threaded or mounted on this second elastic loop. Moreover, such a border could be used to interconnect the borders of a number of clip-frames that may be mounted on the same wall.

Certain embodiments of the invention will now be described, by way of example only, with reference to the accompanying drawings, in which.

Figure 1:
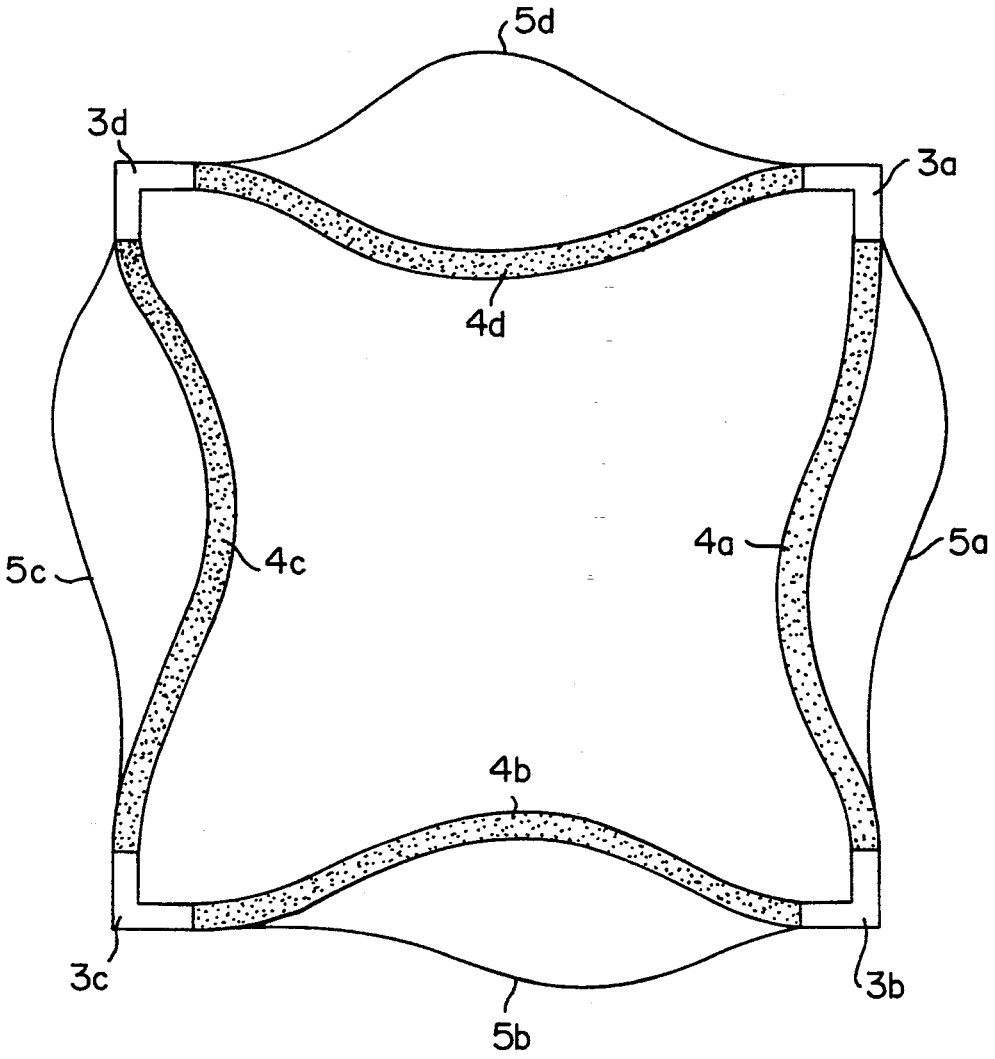
FIG. 1 shows a border assembly according to a first embodiment of the present invention, in its free relaxed state.
Figure 2:
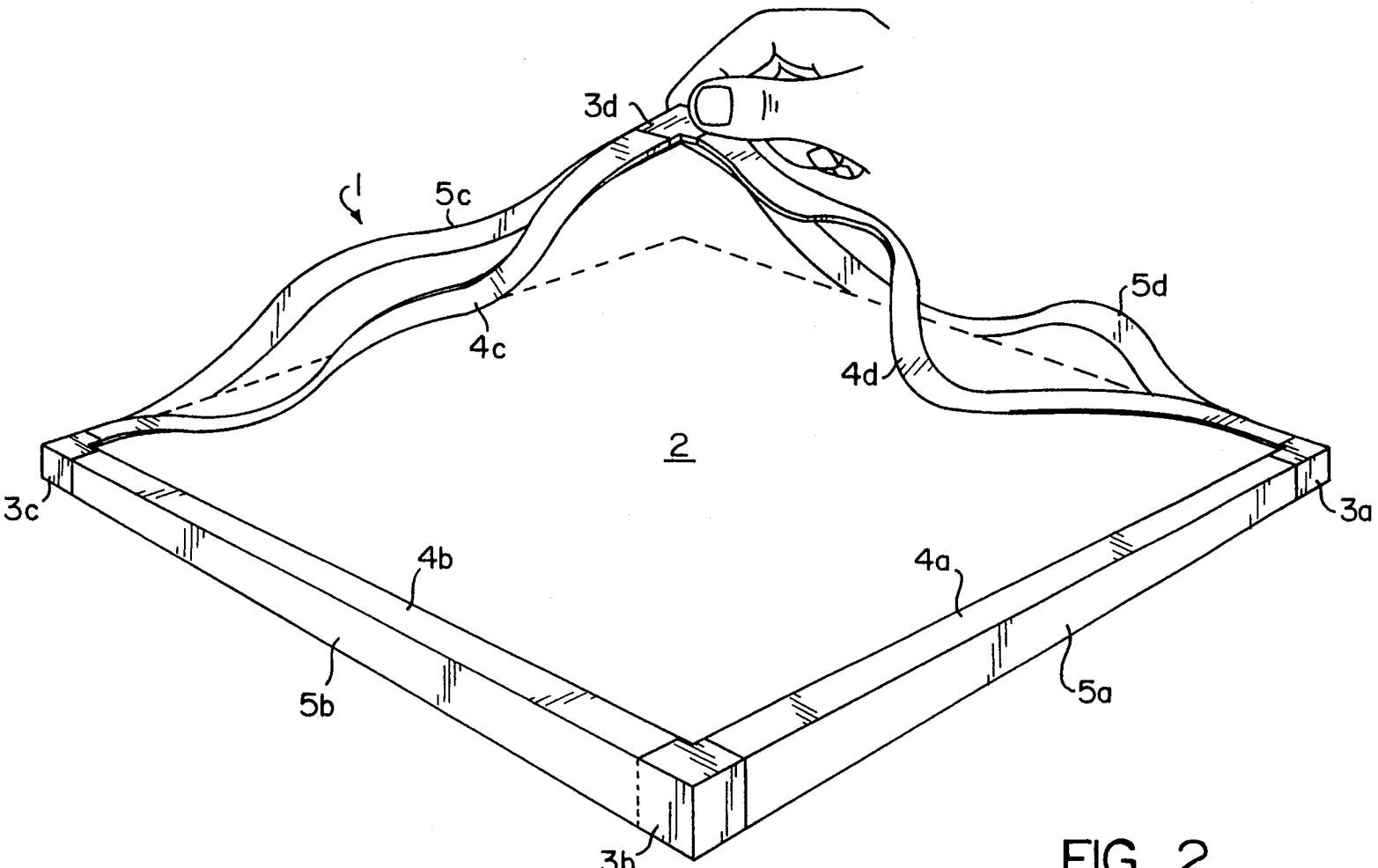
FIG. 2 shows the assembly of FIG. 1 in the process of being positioned around the periphery of a clip-frame.

Referring to FIG. 1, a border assembly 1 according to a first embodiment of the invention is shown in its relaxed state, prior to being fitted onto a clip-frame assembly 2 (see FIG. 2).

The assembly 1 comprises four corner pieces 3*a*–3*d* and eight elastic elements 4*a*–4*d*, 5*a*–5*d* (where the text relates to all or each of the corner pieces or to all or each of the elastic elements the reference letters will be omitted). The eight elastic elements 4,5 are split into four pairs of first 4 and second 5 elastic elements, with adjacent ones of the corner pieces 3 having a pair of these elastic elements 4,5 connected between them. As will be described in more detail later, each pair of elastic elements 4,5 is connected between the corner pieces 3 in such a way that, when pulled taut, the first elastic element 4 of each pair lies in the plane of the paper, and the second elastic element 5 of each pair lies in a plane perpendicular to the plane of the paper, with both of the elastic elements 4,5 of each pair extending in a straight line between the corner pieces 3. This can clearly be seen in FIG. 2.

In FIG. 2, a clip-frame 2 is shown in the process of being framed. Three of the corner pieces 3*a*–3*c* are shown already in position, with the fourth corner piece 3*d* about to be set in place.

The border assembly 1 is fitted to the clip-frame 2 by firstly placing two adjacent ones of the corner pieces 3*a*, 3*b* over two adjacent corners of the clip-frame 2. During positioning of the two corner pieces 3*a*, 3*b* over the corners, the associated pair of elastic elements 4*a*,5*a* become stretched and extend between the two corner pieces 3*a*, 3*b* in a straight line, with the first elastic element 4*a* lying flat along a peripheral edge of the front base of the clip-frame, and with the second elastic element 5*a* lying flat along a side edge of the clip-frame 2. The tension in the elastic elements 4*a*,5*a* both keeps the corner pieces 3*a*, 3*b* in place, by urging the corner pieces 3 against the side edges of the clip-frame 2, and also keeps the elastic elements 4*a*, 5*a* themselves in position, flat against the clip-frame 2 and at right angles to each other.

The bottom left hand corner piece 3*c* may be positioned next, with the elastic elements 4*b*,5*b* again stretching along the periphery of the front face and a side edge of the clip-frame 2. Finally the fourth corner piece 3*d* may be similarly positioned.

With all of the corner pieces 3 in position, and with all of the elastic elements 4,5 consequently pulled taut, the periphery of the front face of the clip-frame 2 is covered by the first elastic elements 4, and the four side edges are covered by the second elastic elements 5. In this way, an attractive frame-like border is formed completely around the assembly.

Figure 3:
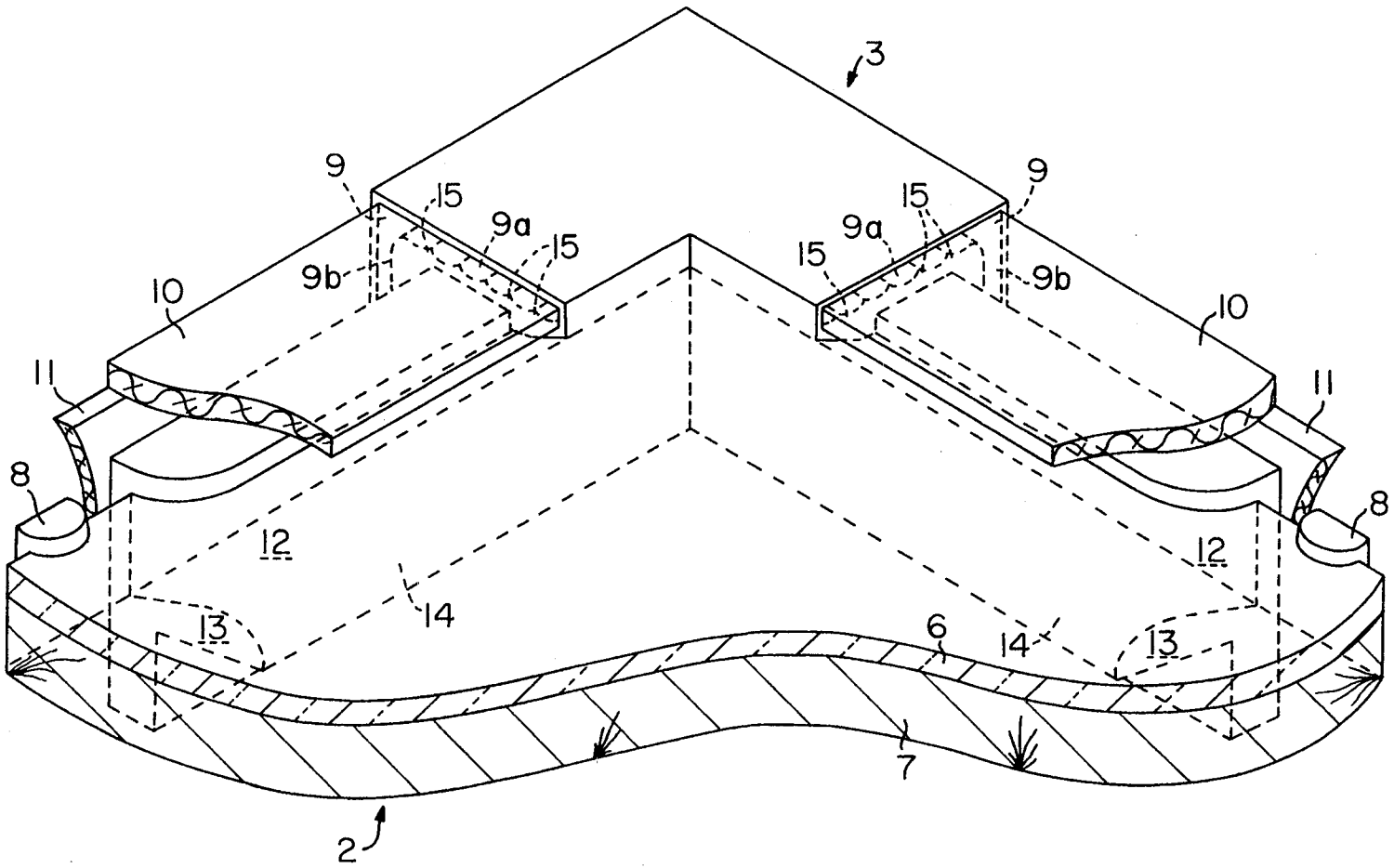
FIG. 3 is a more detailed perspective view of a corner piece in accordance with the present invention showing in phantom the elastic loops extending through the corner piece and the clip-frame assembly on which the corner piece is mounted.

FIG. 3 shows one form of corner piece 3 which may be used in the present invention, mounted on a clip-frame 2 comprising a glass front plate 6, a supporting back board 7, and clips 8 to hold the plate 6 and board 7 together.

The corner piece 3 is provided with a single guide channel 9 running therethrough of right angular cross section which defines a front guide channel portion 9*a* and a side guide channel portion 9*b*. A pair of front 10 and side 11 elastic loops extend through the front and side guide channel portions 9*a*, 9*b* respectively to define two pairs of the elastic elements 4, 5 shown in FIG. 2. The guide channel portions 9*a*, 9*b* are slightly spaced from the front and side surfaces of the clip-frame 2 so that the front and side loops 10, 11 are clear of the clips 8.

The corner piece 3 also comprises a seating channel 12 for mounting it on the clip-frame 2. The rear wall 13 of the seating channel 12 is provided with an arcuate lower surface 14 which bears against the rear surface of the back board 7.

When the clip-frame 2 is inserted into the seating channel 12, the rear wall 13 is pushed outwardly and exerts a reactive force on the back board 7 to clampingly engage the corner piece 3 on to the clip-frame 2. As shown, the seating channel 12 may be extended some distance along the edges of the clip frame 2 in order to ensure that the corner piece 3 is held firmly in place.

Figure 4:
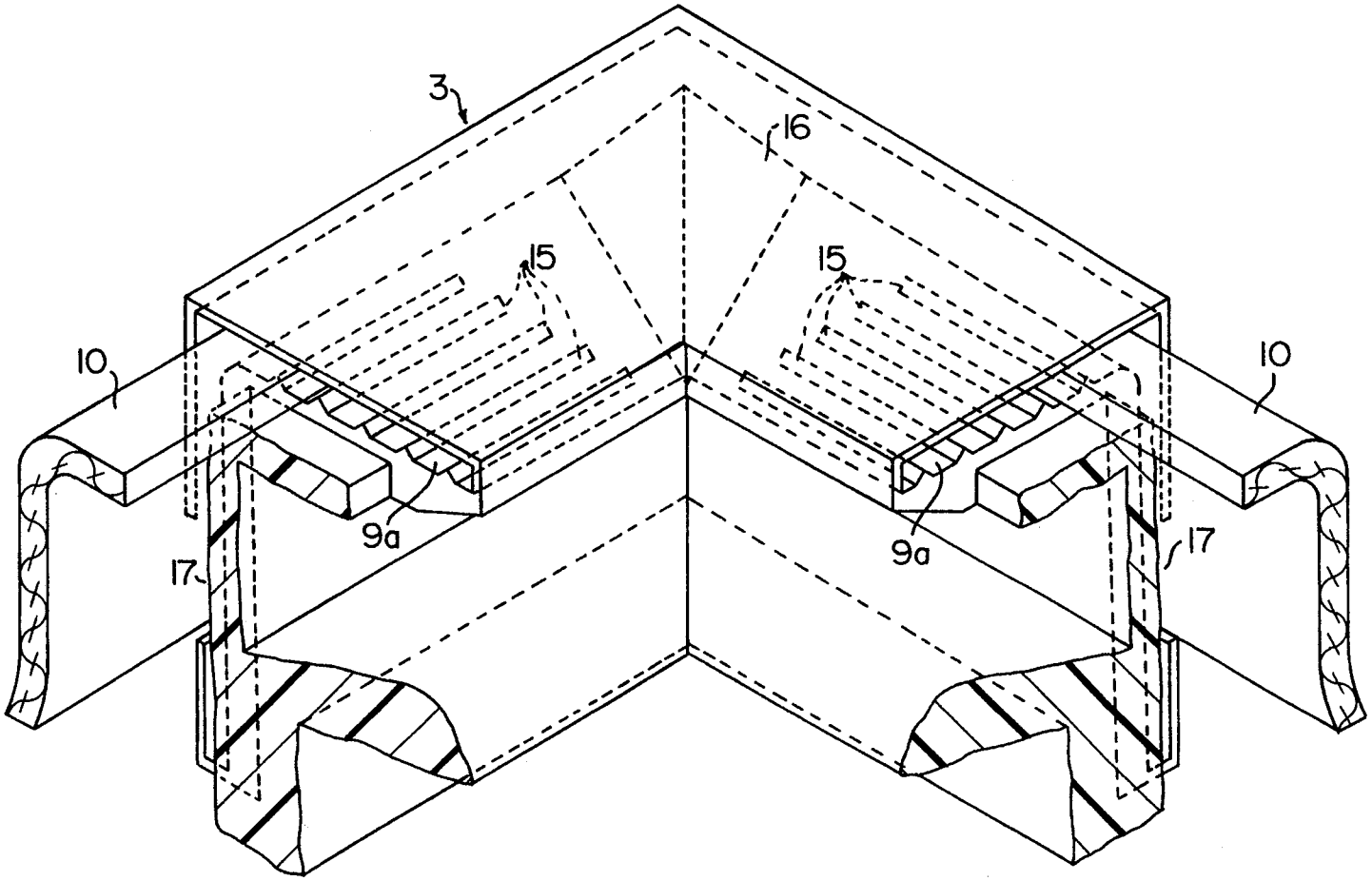
FIG. 4 is a similar view to FIG. 3, but with parts of the seating channel cut away, showing internal features of the corner pieces by dotted lines, and an elastic loop in the process of being inserted therein.

Guide ribs 15 are provided in the front channel portion 9*a* and cooperate with ribs (not shown) that run along the surface of the front elastic loop 10. These guide ribs 15 are best described with reference to FIG. 4 which also shows a ramp 16 mounted within the front guide channel portion 9*a*. The ramp 16 and guide ribs 15 prevent the front elastic loop 10 (shown in the process of being inserted into the guide channel through a slot 17) from tucking up at the point at which it changes direction, and they also negate any tendency the loop 10 may have to splay outwardly and try to straighten up. Further, the ramp 16 prevents the side loop 11 (shown in FIG. 3) from riding up into the front guide channel portion 9*a*. The slot 17 through which the front loop 10 is inserted runs continuously along the outer side surface of the corner piece 3.

Means such as a clip (not shown) may be provided to cover the slot 17, after the elastic loops 10, 11 have been inserted into the guide channel portions 9*a*, 9*b* so as to provide a more decorative effective.

As can be seen in FIG. 2, when the corner pieces and elastic loops are placed around a clip-frame 2, a border is provided which bears a remarkable resemblance to a traditional picture frame. Unlike conventional frames however, the present border assembly is inexpensive, extremely quickly and easily mounted, and may conform to a variety of different sizes and shapes of clip-frame.

One of the corner pieces 3 may be fixedly positioned on the loops 10, 11 to cover a join in the loops and the remaining three corner pieces 3 may slide along the loops to take up any desired position. Such an arrangement not only allows the border assembly to be used on, for example, clip-frames of a given size range, but also allows the border to be used on long and narrow clip-frames or well as on shorter and wider ones without having any problems with regard to unequal tensioning of the elements.

Figure 5:
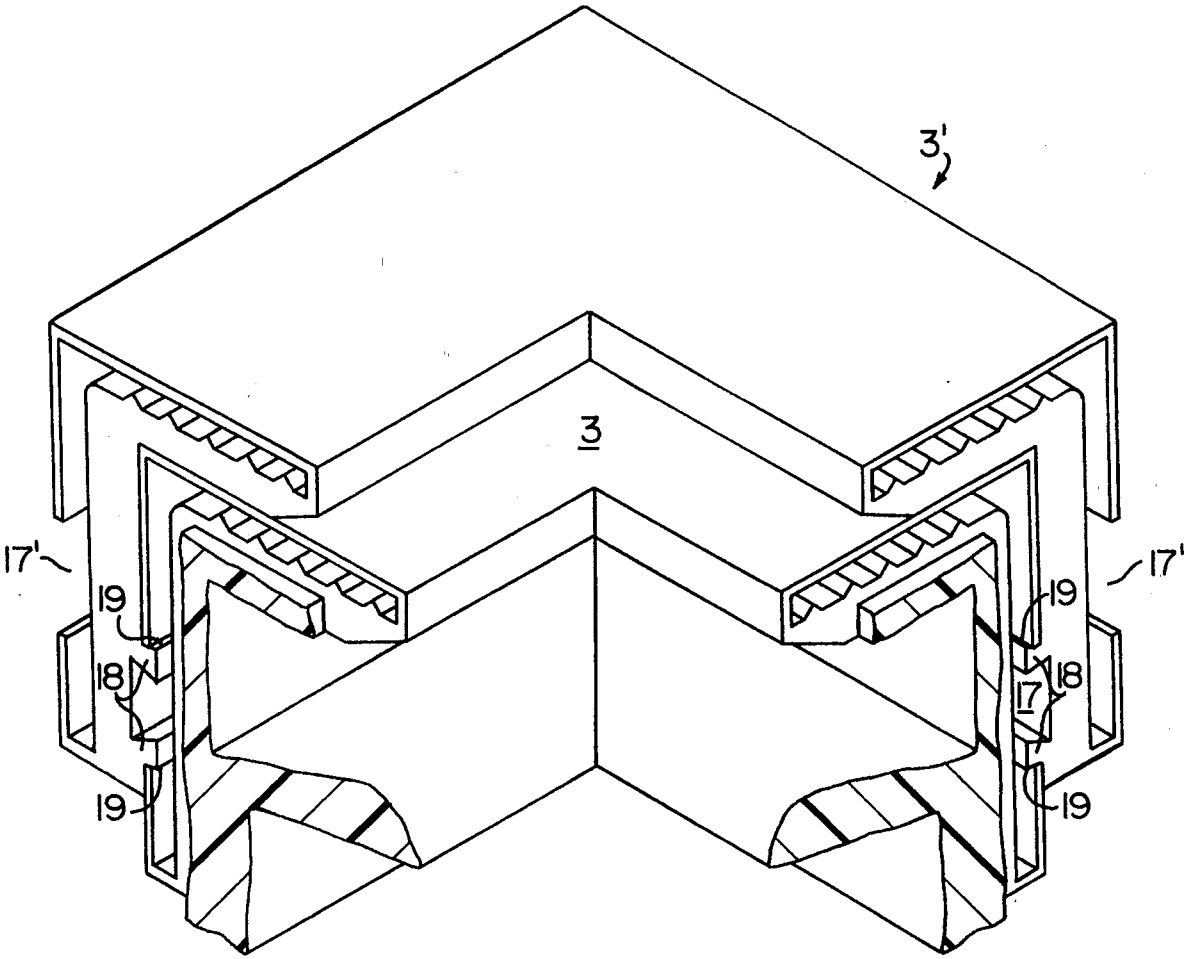
FIG. 5 is a perspective view of the corner piece of FIG. 3 with parts of its seating channel cut away and with a second corner piece mounted above it.
Figure 6:
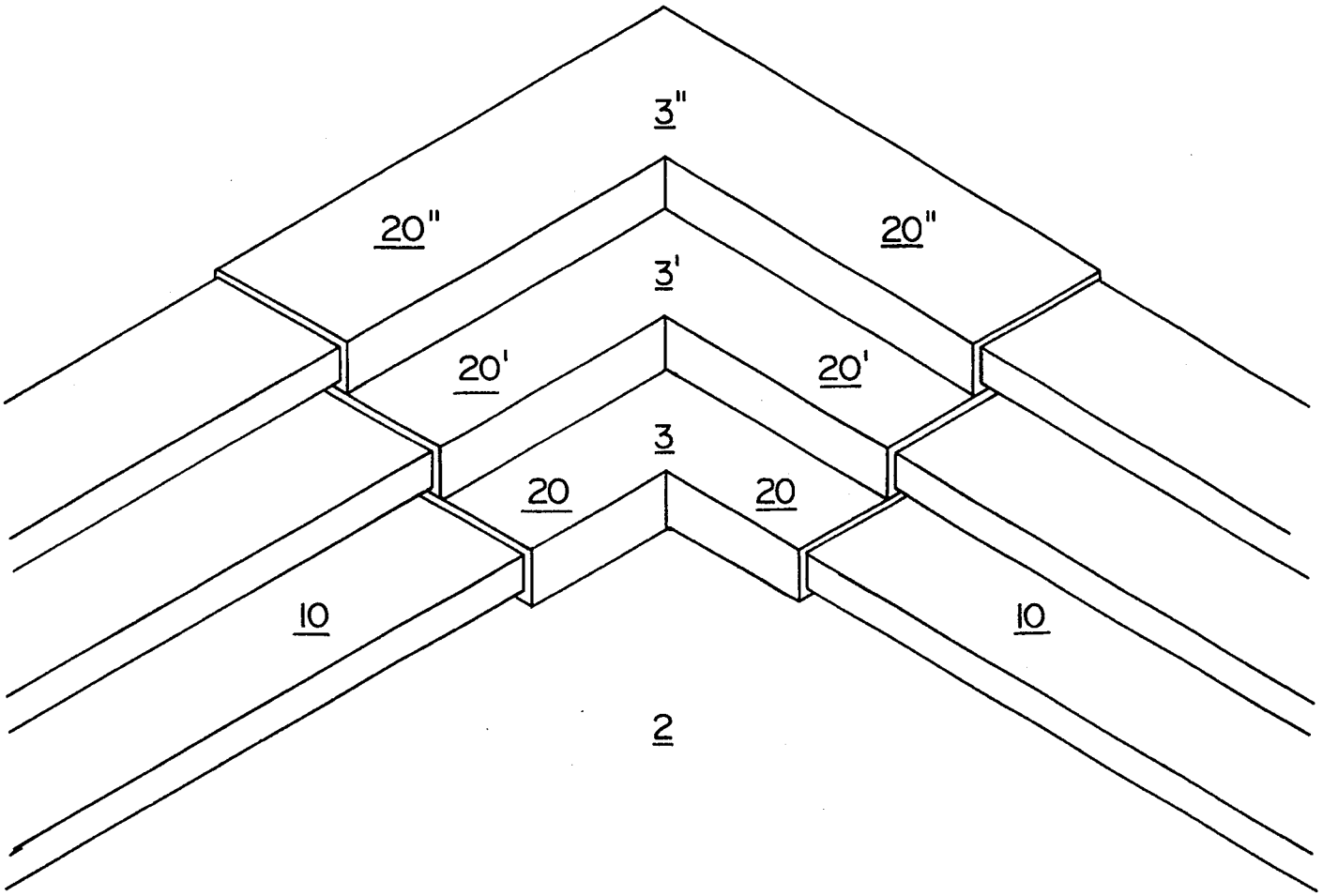
FIG. 6 is a perspective view of the corner of a clip-frame showing three border assemblies in accordance with the present invention mounted thereon and stacked one upon the other.

The versatility of the present invention can be further increased by enabling the border assembles to stack one upon the other, and such an arrangement is shown in FIGS. 5 and 6.

In FIG. 5, a second corner piece 3' is shown mounted on corner piece 3. Corner piece 3' does not have a seating channel 12, since this would prevent it from fitting snuggly over corner piece 3. Instead, in order to fixedly mount the corner piece 3' onto corner piece 3, it is provided with projecting ridges 18 having flanges 19 which clip into the slot 17 and interlock with the inner wall of the guide channel portion 9*b* around the periphery of the slot 17. Corner piece 3' is itself provided with a slot 17' to allow for the insertion of its elastic loops, and, as shown in FIG. 6, a further corner piece 3'' similar to corner piece 3' may be mounted thereon to provide a three tier stacked appearance.

In the embodiment shown in FIG. 6, the arms 20, 20', 20'' of the corner pieces 3, 3', 3'' are of gradually increasing lengths so that they extend to the same point along the sides of the clip-frame 2. The arms 20, 20', 20'' are also of gradually decreasing widths to enhance the stacked effect.

Many variations on the presently described embodiments are envisaged. For example, the two elastic loops 10, 11 may be formed as a single elastic loop of right angular cross section, and, instead of using loops, individual elastic elements could extend between the adjacent corner pieces. In this latter case, the elements could be connected to the corner pieces by hook or plug means.

Also, there is no need to limit the border assemblies to four sided objects, since they could be equally well used on objects of any number of sides, in which case the number of corner pieces used will increase accordingly and the angle between the arms changed accordingly.

I claim:

1. A collapsible border assembly comprising:

a plurality of spaced apart corner pieces; and a plurality of elastic elements;

wherein adjacent corner pieces are interconnected by at least one of said elastic elements; and wherein said elastic elements are connected to said corner pieces in such a manner that said elastic elements conform to a right-angular cross-section when stretched taut between said corner pieces;

said stretched elastic elements at least in part providing an exposed border of frame-like appearance.

2. A collapsible border assembly according to claim 1 wherein said adjacent corner pieces are interconnected by a pair of separate said elastic elements, said separate elastic elements being adapted to lie at right angles to one another along their lengths when put into tension.

3. A collapsible border assembly according to claim 1 wherein said adjacent corner pieces are interconnected by a single elastic loop, said corner pieces being provided on said loop.

4. A collapsible border assembly according to claim 1 wherein said adjacent corner pieces are interconnected by a pair of elastic loops, said corner pieces are provided on said loops and said loops are arranged to lie at right angles to one another along their lengths when put under tension.

5. A collapsible border assembly according to claim 1 wherein said elastic elements are located in guide channels in said corner pieces, said guide channels being of right-anglar cross-section.

6. A collapsible border assembly comprising:

a plurality of spaced corner pieces; and
an elastic loop element;
said corner pieces being connected together by said elastic loop element;
said elastic loop element being connected to said corner pieces in such a manner that, when stretched taut between said corner pieces, said elastic element assumes a right-angular cross-section to at least in part provide an exposed border of frame-like appearance; and
said corner piece having a guide channel therein of right angular cross-section through which said elastic loop element passes, ramps and guide ribs being arranged in said guide channel to reduce tucking or misalignment of said loop element in said channel.

7. A collapsible border assembly comprising:
a plurality of spaced apart corner pieces; and
a first and second elastic loop elements;
wherein said corner pieces are connected together by said elastic loop elements;
said first and second elastic loop elements being connected to said corner pieces in such a manner that, when stretched taut between said corner pieces, said first and second elastic loop elements are caused to assume a configuration in which they lie at right angles to one another to at least in part provide an exposed border of frame-like appearance, said border having a front surface comprising said first elastic loop element and side surfaces comprising said second elastic loop element;
each said corner piece comprising a pair of guide channels disposed at right angles to one another, a respective one of said first and second elastic loop elements passing through each said channel; and
each said guide channel through which said first elastic loop element passes including ramps and guide ribs arranged therein to reduce tucking or misalignment of said first elastic loop element.

8. A collapsible border assembly comprising;
a plurality of spaced apart corner pieces; and
a plurality of elastic elements;
wherein each said elastic element interconnects a pair of said corner pieces;
said elastic elements being connected to said corner pieces in such a manner that, when stretched taut between said corner pieces, said elastic elements at least in part provide an exposed border of frame-like appearance; and
said corner pieces being provided with interlocking formations arranged such that said corner pieces may be engaged with respective corner pieces of a further border assembly whose corner pieces are provided with co-operating formations.

9. A collapsible border assembly according to claim 8 wherein said interlocking formations comprise slots which also permit said elastic elements to be removably engaged with said corner pieces.

10. A collapsible border assembly according to claim 1 wherein said corner pieces comprise seating channel defining portions for engaging an object to be framed and for holding the assembly firmly thereon.

11. A method of providing a border about an object, said object having a front face, sides oriented at right angles to said front face, and a plurality of corners, said method comprising the step of engaging the object by an assembly as claimed in claim 1, wherein said corner pieces are engaged with respective corners of said object in such a manner that said elastic elements are put into tension and in such a manner that each said elestic element lies along a said side of said object and along a corresponding peripheral edge of said front face.

12. A border assembly comprising:
a plurality of pairs of first and second strip-like elastic elements; and
a plurality of spaced apart corner pieces;
wherein each said pair of elastic elements is connected to another said pair of elastic elements by a said corner piece;
each said corner piece comprising a pair of connecting portions, each said connecting portion mounting a said pair of elastic elements thereon;
each said connecting portion being of a right-angular configuration; and
said pairs of elastic element being mounted on said connecting portions in such a manner that, when one of said pairs of elastic elements is stretched taut between two said corner pieces, said stretched pair of elastic elements conform to said right-angular configuration of said connecting portions, said first elastic element of said stretched pair lying at a right angle to said second elastic element of said stretched pair along their lengths, said stretched pairs of elastic elements at least in part providing an exposed border having a frame-like appearance.

13. A picture mounting assembly comprising:
a transparent front panel;
a support panel;
means for interconnecting said transparent panel and said support panel in opposed relation to one another to provide a frame, a picture being received between said panels; and
an exposed border for said frame, said border comprising a plurality of pairs of first and second strip-like elastic elements interconnected by corner pieces;
wherein said corner pieces are mounted on respective corners of said frame;
said elastic elements are stretched taut between said corner pieces; and
each said stretched first elastic element lies flat along a peripheral edge of a front face of said transparent front panel, and each said stretched second elastic element lies flat along a corresponding side edge of said frame.

* * * * *